US009095026B2

(12) United States Patent
Horsky et al.

(10) Patent No.: US 9,095,026 B2
(45) Date of Patent: Jul. 28, 2015

(54) LED CONTROLLER AND METHOD THEREFOR

(71) Applicant: SEMICONDUCTOR COMPONENTS INDUSTRIES, LLC, Phoenix, AZ (US)

(72) Inventors: Pavel Horsky, Brno (CZ); Petr Kamenicky, Brno (CZ)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 0 days.

(21) Appl. No.: 14/559,119

(22) Filed: Dec. 3, 2014

(65) Prior Publication Data

US 2015/0189711 A1 Jul. 2, 2015

Related U.S. Application Data

(60) Provisional application No. 61/923,152, filed on Jan. 2, 2014.

(51) Int. Cl.

| | |
|---|---|
| ***H05B 37/00*** | (2006.01) |
| ***H05B 41/00*** | (2006.01) |
| ***H05B 33/08*** | (2006.01) |
| ***H05B 33/10*** | (2006.01) |

(52) U.S. Cl.

CPC ..... *H05B 33/0827* (2013.01); *H05B 33/0845* (2013.01); *H05B 33/10* (2013.01)

(58) Field of Classification Search

CPC ..... H05B 37/00; H05B 41/00

USPC ..... 257/296

See application file for complete search history.

(56) References Cited

U.S. PATENT DOCUMENTS

| | | | | |
|---|---|---|---|---|
| 7,339,323 | B2 | 3/2008 | Bucur | |
| 7,994,725 | B2 | 8/2011 | Bouchard | |
| 2010/0134041 | A1 * | 6/2010 | Radermacher et al. | 315/294 |
| 2012/0062122 | A1 * | 3/2012 | Xi et al. | 315/120 |

OTHER PUBLICATIONS

On Semiconductor, "Light Management IC Dedicated for LCD Backlighting and Multi-LED Fun Light Applications," Semiconductor Components Industries, LLC, Jul. 2009, Rev. 1, Publication Order No. NCP5890/D, 19 pages.

* cited by examiner

*Primary Examiner* — Marc Armand
(74) *Attorney, Agent, or Firm* — Robert F. Hightower

(57) ABSTRACT

In an embodiment, an LED controller is configured to form a charge transfer sequence to selectively enable LED transistors of a plurality of LED transistors that are configured for coupling in parallel with a plurality of LEDs. An embodiment may include that the LED controller is configured to sequentially couple a charge capacitor to a gate-to-source capacitor of each LED transistor of the plurality of LED transistors to one of charge or to refresh the gate-to-source capacitor of a respective LED transistor and to one of enable or re-enable the respective LED transistor wherein the gate-to-source capacitor is a parasitic gate-to-source capacitor of the LED transistor wherein the charge capacitor is sequentially coupled to the gate-to-source capacitor of each LED transistor.

20 Claims, 7 Drawing Sheets

LED CONTROLLER AND METHOD THEREFOR

PRIORITY CLAIM TO PRIOR PROVISIONAL FILING

This application claims priority to prior filed Provisional Application No. 61/923,152 entitled "LED CONTROLLER AND METHOD THEREFOR" filed on Jan. 2, 2014, and having common inventors Pavel Horsky et al. which is hereby incorporated herein by reference

BACKGROUND OF THE INVENTION

The present invention relates, in general, to electronics, and more particularly, to semiconductors, structures thereof, and methods of forming semiconductor devices.

In the past, the electronics industry utilized various methods and structures to control light sources such for example an LED light source. In some applications, an LED driver for driving LEDs connected in a series string may have used floating switches, which can selectively short ones of the LEDs. Such switches were sometimes used to individually control light intensity produced by each LED, for example by using PWM dimming. Each LED could be controlled separately and the intensity of each LED could be controlled in the range from one hundred to zero percent (100% to 0%). The switches could also be used for shaping of the light beam.

In some embodiments, the switches may have been floating relative to ground potential. In one embodiment, they could be constructed as MOS transistors or alternately as high voltage MOS transistors. In some applications it was difficult to charge the intrinsic gate-to-source capacitance of the MOS transistors to a voltage sufficient to enable the MOS transistor. In other embodiments, the gate-to-source voltage may not be formed very accurately and the MOS transistor may not be properly enabled.

Accordingly, it is desirable to have a method and apparatus to enable the MOS transistor, or to form a more accurate gate-to-source voltage, or to charge the gate-to-source capacitance to a sufficient voltage to enable the MOS transistor.

Figure 1:
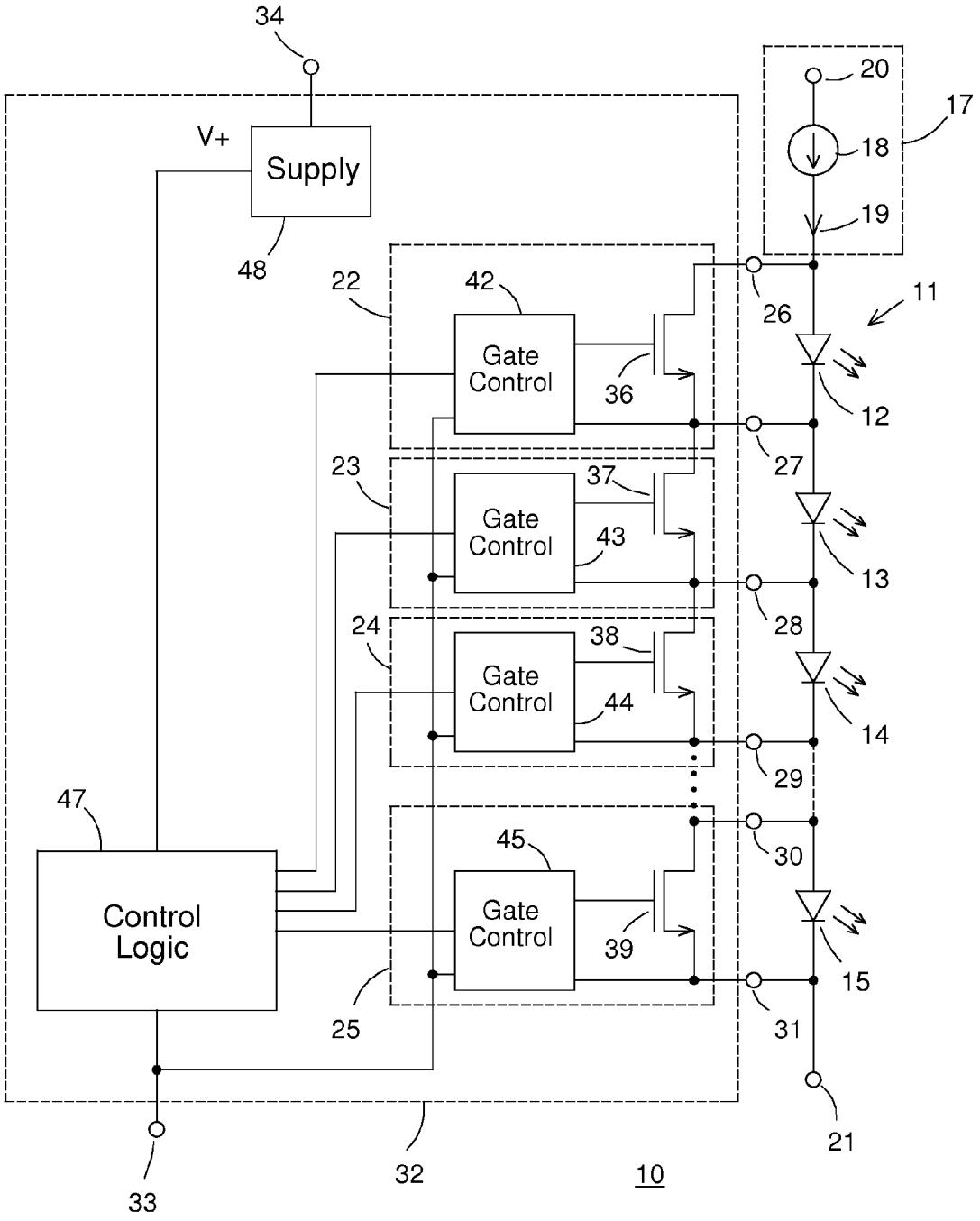
FIG. 1 schematically illustrates a portion of an example of an embodiment of a lighting system that includes a controller for controlling a brightness of a plurality of light sources in accordance with the present invention.

For simplicity and clarity of the illustration(s), elements in the figures are not necessarily to scale, some of the elements may be exaggerated for illustrative purposes, and the same reference numbers in different figures denote the same elements, unless stated otherwise. Additionally, descriptions and details of well-known steps and elements may be omitted for simplicity of the description. As used herein current carrying element or current carrying electrode means an element of a device that carries current through the device such as a source or a drain of an MOS transistor or an emitter or a collector of a bipolar transistor or a cathode or anode of a diode, and a control element or control electrode means an element of the device that controls current through the device such as a gate of an MOS transistor or a base of a bipolar transistor. Additionally, one current carrying element may carry current in one direction through a device, such as carry current entering the device, and a second current carrying element may carry current in an opposite direction through the device, such as carry current leaving the device. Although the devices may be explained herein as certain N-channel or P-channel devices, or certain N-type or P-type doped regions, a person of ordinary skill in the art will appreciate that complementary devices are also possible in accordance with the present invention. One of ordinary skill in the art understands that the conductivity type refers to the mechanism through which conduction occurs such as through conduction of holes or electrons, therefore, that conductivity type does not refer to the doping concentration but the doping type, such as P-type or N-type. It will be appreciated by those skilled in the art that the words during, while, and when as used herein relating to circuit operation are not exact terms that mean an action takes place instantly upon an initiating action but that there may be some small but reasonable delay(s), such as various propagation delays, between the reaction that is initiated by the initial action. Additionally, the term while means that a certain action occurs at least within some portion of a duration of the initiating action. The use of the word approximately or substantially means that a value of an element has a parameter that is expected to be close to a stated value or position. However, as is well known in the art there are always minor variances that prevent the values or positions from being exactly as stated. It is well established in the art that variances of up to at least ten per cent (10%) are reasonable variances from the ideal goal of exactly as described. When used in reference to a state of a signal, the term "asserted" means an active state of the signal and the term "negated" means an inactive state of the signal. The actual voltage value or logic state (such as a "1" or a "0") of the signal depends on whether positive or negative logic is used. Thus, asserted can be either a high voltage or a high logic or a low voltage or low logic depending on whether positive or negative logic is used and negated may be either a low voltage or low state or a high voltage or high logic depending on whether positive or negative logic is used. Herein, a positive logic convention is used, but those skilled in the art understand that a negative logic convention could also be used. The terms first, second, third and the like in the claims or/and in the Detailed Description of the Drawings, as used in a portion of a name of an element are used for distinguishing between similar elements and not necessarily for describing a sequence, either temporally, spatially, in ranking or in any other manner. It is to be understood that the terms so used are interchangeable under appropriate circumstances and that the embodiments described herein are capable of operation in other sequences than described or illustrated herein. Reference to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment, but in some cases it may. Furthermore, the particular features, structures or characteristics may be combined in any suitable manner, as would be apparent to one of ordinary skill in the art, in one or more embodiments.

DETAILED DESCRIPTION OF THE DRAWINGS

FIG. 1 schematically illustrates a portion of an example of an embodiment of a lighting system 10 that includes a controller that is configured for controlling a brightness of a plurality of series connected illumination sources or light sources. In a particular embodiment, the controller may be configured as an LED controller 32 that may be formed to control a string 11 of a plurality of series connected LEDs such as LEDs 12-15 that form the illumination sources. Those skilled in the art will appreciate that the illumination sources may be other types of illumination sources in other embodiments such as for example a lamp. String 11 usually receives a current, such as an LED current 19, to operate LEDs 12-15 from a power supply 17. In one embodiment, power supply 17 may include a current source 18 that is coupled to receive operating power from a power source coupled between a power input 20 and a power return 21. In an embodiment, the power source may be a d.c. power source formed from an a.c. voltage or may be a d.c. source such as a battery. In an embodiment, return 21 may be a common return such as for example a ground return.

Controller 32 is configured to have a plurality of control channels 22-25 that correspond to respective LEDs 12-15. Thus, each channel of channels 22-25 is configured to be connected in parallel with the corresponding LED of LEDs 12-15. For example, channel 22 is configured to be connected in parallel with LED 12, channel 23 is configured to be connected in parallel with LED 13, etc. Each of channels 22-25 are configured to include a respective switch transistor 36-39 that is configured for connecting in parallel to the corresponding LED. For example, channel 22 includes a switch transistor 36 that is configured for connecting in parallel with LED 12, channel 23 includes a switch transistor 37 that is configured for connecting in parallel with LED 13, channel 24 includes a switch transistor 38 that is configured for connecting in parallel with LED 14, and channel 25 includes a switch transistor 39 that is configured for connecting in parallel with LED 15. Those skilled in the art will appreciate that although controller 32 is illustrated to include only four channels and some of the descriptions may include only three channels, controller 32 may be formed with any number (N) of channels where N may be greater than or less than four (4). Controller 32 is configured to selective enable individual ones of transistors 36-39 via respective channels 22-25 to control a brightness of each of corresponding LEDs 12-15. Controller 32 may also include output terminals to assist in coupling each channel in parallel with the respective LED. For example, controller 32 may include output terminals or outputs 26-31. In an embodiment, transistors 36-39 may be connected is a series string such that an electrode of one transistor is connected to an opposite electrode of the adjacent transistor. For example, a source of transistor 36 may be connected to a drain of transistor 37, a source of transistor 37 may be connected to a drain of transistor 38, and a source of transistor 38 may be connected to a drain of transistor 39. Since transistor 39 is the last transistors in the series connection, the source of transistor 39 is configured to be coupled to an electrode of the last LED in string 11. Controller 32 may also be configured to be coupled to a charge capacitor to assist in enabling one or more of transistor 36-39. In an embodiment, the charge capacitor may be included within controller 32. Those skilled in the art will appreciate that although each of transistor 36-39 is illustrated as being connected in parallel with one LED, any one of transistors 36-39 may be connected in parallel with more than one LED. For example, transistor 36 may be connected in parallel to two or more series connected LEDs. Such as for example, a source of transistor 36 may be connected to a cathode of one LED of the two or more series connected LEDs and the drain of transistor 36 may be connected to an anode of a different one of the two or more series connected LEDs. In another example, LED 12 may be replaced by a plurality of series connected LEDs.

Each of channels 22-25 may also include a gate control circuit that is configured to assist in enabling the corresponding switch transistor of the channel. An embodiment may include that channels 22-25 include respective gate control circuits 42-45.

Controller 32 also includes control logic 47 that is configured to form control signals to control each channels 22-25 to control a brightness of LEDs 12-15. Control logic 47 may be formed from logic elements such as gates, latches, etc, or may be configured as a micro-processor or micro-controller or may be a combination of such elements. In some embodiments, controller 32 may also include an internal power supply 48 that forms operating voltages to operate the elements of controller 32. For example, supply 48 may be connected to receiver power between a power input terminal 34 and a power return terminal 33. In some embodiments, return 33 may be connected to a common return voltage such as a ground voltage.

In an embodiment, controller 32 may be configured to sequentially couple the charge capacitor to a plurality of transistors, such as for example transistors 36-39, to one of sequentially enable or alternately re-enable one or more of the plurality of transistors. An embodiment may also include that one or more of the plurality of transistors is configured for coupling in parallel to an LED of a plurality of LEDs.

Figure 2:
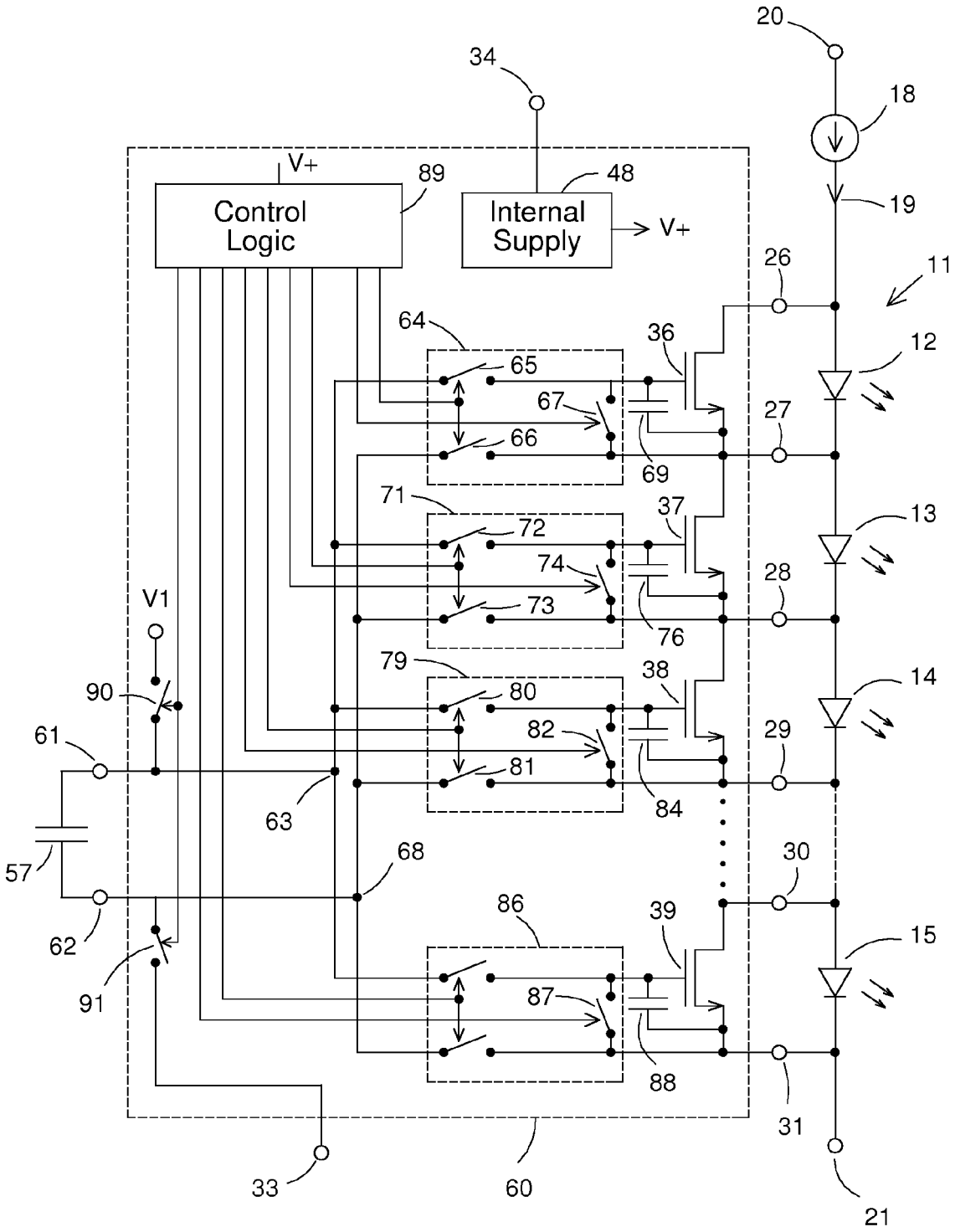
FIG. 2 schematically illustrates a portion of an example of an embodiment of an LED controller that is an alternate embodiment of the controller of FIG. 1 in accordance with the present invention.

FIG. 2 schematically illustrates a portion of an example of an embodiment of an LED controller 60 that is an alternate embodiment of controller 32 that was described in the description of FIG. 1. In an embodiment, controller 60 may be substantially the same as and operate substantially the same as controller 32. Controller 60 includes control logic 89 that in an embodiment may be similar to and operates substantially similar to control logic 47 that was described in the description of FIG. 1. Controller 60 also includes gate control circuits 64, 71, 79, and 86 that in an embodiment may be similar to and operate substantially the same as respective circuits 42-45, except that circuits 64, 71, 79, and 86 are illustrated with specific example embodiments. Controller 60 may include control channels that are similar to channels 22-25 of FIG. 1. Circuit 64 and transistor 36 may be a portion of a first control channel of controller 60, circuit 71 and transistor 37 may be a portion of a second control channel, circuit 79 and transistor 38 may be a portion of a third control channel, and circuit 86 and transistor 39 may be a portion of a fourth control channel.

In an embodiment, controller 60 may be configured for coupling to a charge capacitor 57. For example, controller 60 may include terminals 61 and 62 that are configured for coupling to two different terminals of capacitor 57. An embodiment may also include that controller 60 includes switches 90 and 91 that are configured to be operated by controller 60, or alternately by logic 89 to charge capacitor 57 or to assist in transferring change from capacitor 57. In an alternate embodiment, such as for example the embodiment of controller 32 described in the description of FIG. 1, a charge transfer capacitor such as capacitor 57 may be internal to the controller, such as controller 32, along with switches 90 and 91.

As will be understood by those skilled in the art, transistors 36-39 each have an intrinsic parasitic gate-to-source capacitance that must be charged to enable the transistor may be enabled. These intrinsic parasitic capacitances of transistors 36-39 are illustrated in FIG. 2 by respective capacitors 69, 76, 84, and 88. However, in some embodiments, an optional additional capacitor (not shown) may be added in parallel between the source and gate of any one of transistors 36-39. Since each of transistors 36-39 has a source that is referenced to the voltage on a different one of LEDs 12-15, the voltage and amount of charge required to enable different ones of transistors 36-39 varies. For example a higher voltage may be required to enable transistor 36 than is required to enable transistor 37 or transistor 39. However, in an embodiment the threshold voltage of each of transistors 36-39 may all be close in value. Thus, the gate-to-source voltage (Vgs) required to enable each of the transistors may be similar even though the total gate voltage (relative to the common reference value, such as for example the voltage on terminal 33) may be different. In an embodiment, gate control circuits 64, 71, 79, and 86 are configured to form a Vgs for respective transistors 36-39 that is no less than the threshold voltage of the transistor in order to enable the respective transistor. An embodiment may include that circuits 64, 71, 79, and 86 are configured to form a Vgs for respective transistors 36-39 that is greater than the respective threshold voltage of the transistor. In an embodiment, capacitor 57 may be used to assist in charging the gate-to-source capacitance of transistors 36-39 to form the desired Vgs instead of using a high voltage supply and/or voltage regulators in each gate control circuit.

In an embodiment, each of gate control circuits 64, 71, 79, and 86 may include a pair of charge switches that are controlled by controller 60, or alternately controlled by logic 89, to assist in enabling respective transistor 36-39. Each of gate control circuits 64, 71, 79, and 86 may also include a disable switch that is controlled by controller 60, such as for example controlled by logic 89, to assist in disabling respective transistors 36-39. For example, circuit 64 may include charge switches 65 and 66 along with disable switch 67, circuit 71 may include charge switches 72 and 73 along with disable switch 74, and circuit 79 may include charge switches 80 and 81 along with disable switch 82.

Figure 3:
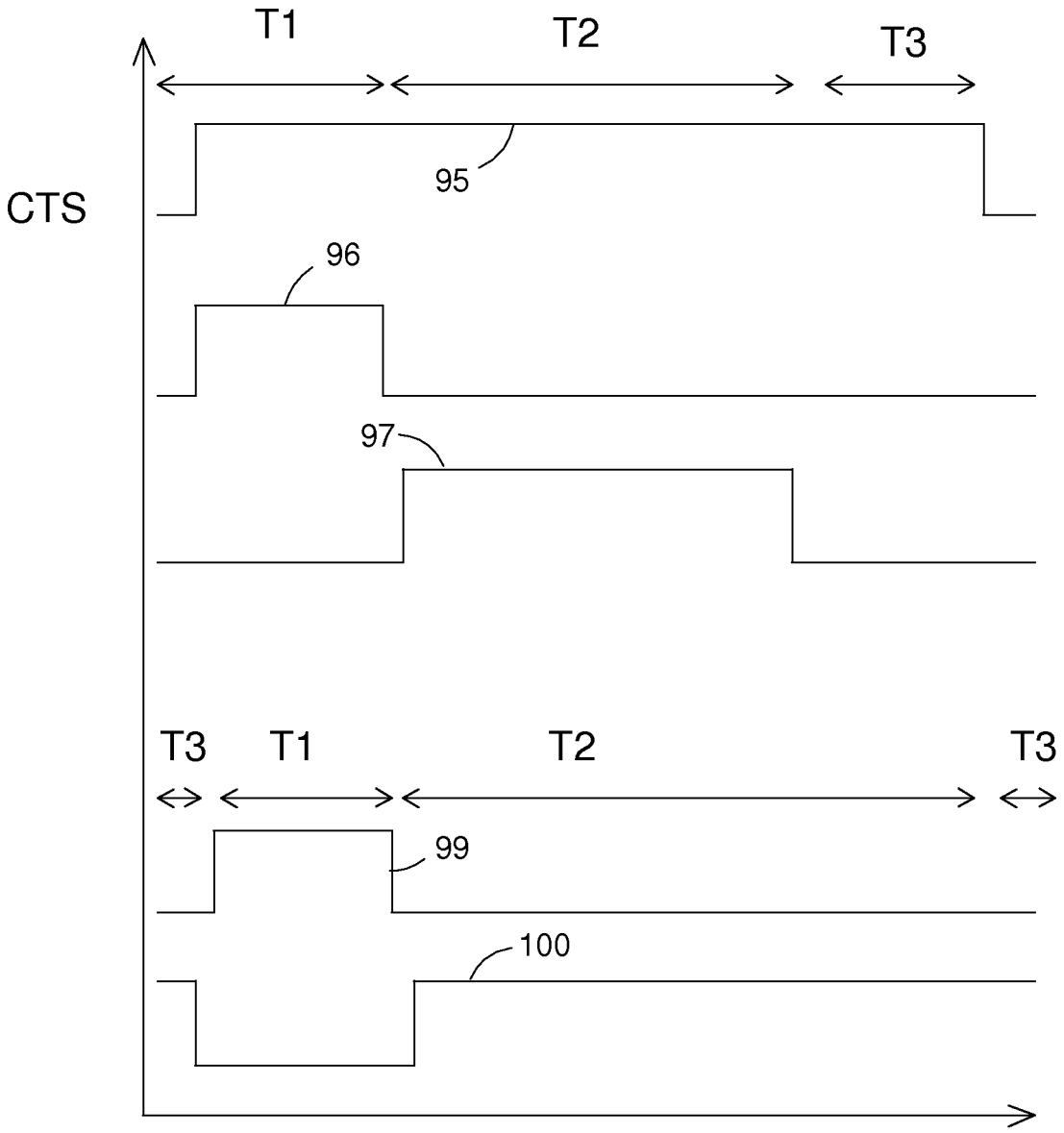
FIG. 3 is a graph having plots illustrating some examples of some of the signals that may be formed by one example embodiment of the controller of FIG. 2 in accordance with the present invention.

FIG. 3 is a graph having plots illustrating some examples of some of the signals that may be formed by one example embodiment of controller 60. The abscissa indicates time and the ordinate indicates increasing value of the illustrated signal. This description has references to FIG. 2 and FIG. 3.

Controller 60 may be configured to form a charge transfer sequence (CTS) that includes a plurality of time intervals including a gate charge interval (GCI). In an embodiment, a GCI may include a plurality of sub-intervals. For example, a GCI may include a transfer time interval or transfer interval and a dead time interval or dead time between opening one set of switches and closing another set of switches to assist minimizing current spikes. In one embodiment, a time interval T2 may be a transfer interval of the gate charge interval (GCI) and time interval T3 may a dead time. In an embodiment, intervals T2 and T3 may be considered as sub-intervals of the GCI. In other embodiments, time interval T3 may be minimized or omitted, or alternately included as an interval of the CTS.

Plots 96-97 of FIG. 3 illustrate one example of a CTS and plots 99-100 illustrate a second example of a CTS. Plot 95 illustrates a charge transfer sequence (CTS). Plot 96 illustrates states of at least one control signal used to operate switches 90 and 91, and plot 97 illustrates states of a control signal used to operate one set of charge switches, such as for example switches 65 and 66. Those skilled in the art will appreciate that although only one control signal is illustrated for switches 90-91 and one control signal is illustrated for controlling switches 65-66, more than one control signal may be used in other embodiments. Those skilled in the art will understand that in an alternate embodiment, switches 66, 73, and 81 may be configured differently than illustrated in FIG. 2 and that the illustrated configuration is for the simplicity of the drawings and explanation. In such an alternate embodiment, the control electrode of switch 66 may be configured to be controlled by switch 65. For example, the control electrode of switch 66 may be connected to the current carrying electrode of switch 65 that is used to form the signal to the gate of transistor 36. Those skilled in the art will appreciate that switches 73 and 81 may also be configured to be controlled by respective switches 72 and 80 in a similar manner as switch 66. For the second example of a CTS, plot 99 illustrates states of the control signal used to operate switches 90 and 91, and plot 100 illustrates states of the control signal used to operate one set of charge switches, such as for example switches 65 and 66. An asserted state of the control signal represents a closed state of the corresponding switch. Those skilled in the art will appreciate the control signal polarities may be different with different types of switches.

In one example embodiment, during a first time interval, such as for example a charging time interval T1, of the charge transfer sequence (CTS), controller 60 controls switches 90 and 91 to close or turn-on switches 90 and 91. Thus, capacitor 57 is charged to a first voltage illustrated by a voltage V1. In one embodiment, voltage V1 may be a voltage from a low voltage supply which may be regulated close to the maximum operational gate-to-source voltage of any of transistors 36-39. In an embodiment, the value of voltage V1 may be greater than the minimum gate-to-source voltage (Vgs) required to enable any one of transistors 36-39. An embodiment may include that voltage V1 is no less than or alternately greater than the threshold voltage (Vth) for enabling any one of transistors 36-39. In an example embodiment, voltage V1 may have value that generally is less that about five (5) volts or it may be approximately three (3) volts or in another embodiment may be less than three volts. An embodiment may include that voltage V1 is formed by supply 48.

Controller 60 may also be configured to subsequently form the gate charge interval (GCI) as a second time interval, for example at least interval T2. For example, controller 60 may initiate forming the second time interval, for example the GCI, after capacitor 57 is charged to approximately V1 or alternately one or more of the time intervals or sub-intervals may have a fixed duration. Controller 60 may be configured to open or disable switches 90 and 91 responsively to completion of the first time interval (or alternately upon initiating the second time interval) and to subsequently form a GCI to connect capacitor 57 between the gate and source of one of transistors 36-39 that is desired to be enabled or turned-on. The selection of which transistors 36-39 to enable is controlled by controller 60, or alternately logic 89, to achieve a desired brightness for an LED. In an embodiment, the selection may be indicated by asserting the control signal coupled to the charge switches of the selected channel. Those skilled in the art will appreciate that to minimize current spikes or alternately to reduce undesirable discharging of capacitor 57 by current spikes, there may be a time interval between opening switches 90-91 and enabling a pair of charge switches to connect capacitor 57 between the gate and source of one of transistors 36-39.

Assume for example that LED 12 should be shorted by transistor 36. Transistor 36 has intrinsic gate-source capacitance 69. Controller 60 is configured to enable or turn-on switches 65-66 during the transfer interval of the GCI so that capacitor 57 can provide a charge to charge capacitor 69 and thereby provide a gate-to-source voltage (V, for transistor 36 that is at least no less than the threshold voltage for enabling transistor 36. In an embodiment, controller 60 is configured to enable switch 66 to connect a negative potential node or terminal of capacitor 57 to the source of transistor 36, and to enable switch 65 to connect a positive potential node or terminal of capacitor 57 to the gate of transistor 36. Thus, capacitor 57 is configured to charge capacitor 69 of transistor 36 and enable transistor 36. Consequently, an embodiment may include that capacitor 57 may be viewed as a source of charge instead of a voltage source. The on-resistance of switches 65-66 together with the capacitance of capacitor 69 and the gate-drain capacitance of transistor 36 will define the slope control of the Vgs signal when charging capacitor 69 to enable transistor 36. In one embodiment, capacitor 57 may typically have a larger capacitance value compared to capacitor 69 (or any of capacitors 76, 84, or 88) and the resulting voltage on capacitor 57 after charging capacitor 69 will be almost equal to the voltage V1 which was used to charge capacitor 57. In an embodiment the capacitance of capacitor 57 may be no less than the sum of the capacitances of the capacitors of the switch transistors, such as for example the sum of the capacitance of capacitors 69, 76, 84, and 88. In an embodiment, the capacitance of capacitor 57 may be approximately one thousand times (1000×) greater than the average value of capacitors 69, 76, 84, and 88. In other embodiments, the capacitance of capacitor 57 may be approximately one hundred times (100×) to approximately ten thousand times (10,000×) greater than the average value of capacitors 69, 76, 84, and 88.

An embodiment of controller 60, or alternately an embodiment of logic 89, may be configured to subsequently disable switches 65-66. Controller 60 may disable switches 65-66 after transistor 36 is enabled or alternately may disable switches 65-66 after a fixed time interval. After switches 65-66 are disabled, the gate of transistor 36 will be floating. The Vgs of transistor 36 is defined by the voltage or alternately the charge stored on capacitor 69, consequently, transistor 36 will stay on after switches 65-66 are opened or turned-off or disabled. It is desirable for the leakages of switches 65-66 to be low. Because the leakage of the switches will not be zero, periodic refresh of capacitor 69, or alternately any of capacitors 76, 84, or 88, may be performed. Those skilled in the art will appreciate that switches 65-66 may be opened or turned-off in other intervals of the charge transfer sequence (CTS). For example, switches 65-66 may be opened or turned-off as a portion of the second time interval, or just prior to the initiation of a following transfer interval for a different channel. For example, switches 65-66 may be opened or turned-off or disabled just prior to initiating a subsequent gate charge interval (GCI) for a subsequent transistor, such as transistor 37, or just prior to the first time interval of a subsequent new CTS sequence or new CGI. There typically is a small time interval, such as for example time interval T3, between opening or turning-off one pair of the charge switches, such as switches 65-66, and closing or enabling another set of switches of another channel, such as for example switches 72-73, in order to minimize current spikes or alternately to minimize undesirable discharging of capacitor 57. Those skilled in the art will appreciate that time interval T3 may be considered a sub-interval of the GCI or may be considered a separate time interval of the CTS.

Those skilled in the art will appreciate that various sequences of periodical operation may be formed. For example, a charge transfer sequence (CTS) may include a plurality of GCI intervals. For example, a CTS may include sequential GCI intervals for a plurality of channels such as a CGI for transistor 36, subsequently a GCI for transistor 37, followed by a GCI for transistor 38. Each GCI may include a plurality of sub-intervals such as for example as illustrated by intervals T2 and T3.

Those skilled in the art will appreciate that an embodiment of a method of forming the LED controller may comprise configuring the LED controller to form a charge transfer sequence to selectively enable LED transistors of a plurality of LED transistors that are configured for coupling in parallel with a plurality of LEDs; and configuring the LED controller to sequentially couple a charge capacitor to a gate-to-source capacitor of each LED transistor of the plurality of LED transistors to one of charge or to refresh the gate-to-source capacitor of a respective LED transistor and to one of enable or re-enable the respective LED transistor wherein the gate-to-source capacitor is a parasitic gate-to-source capacitor of the LED transistor including configuring the LED controller to sequentially couple the charge capacitor to the gate-to-source capacitor of each LED transistor.

The skilled artisan will appreciate that as explained herein, the LED controller is configured with LED transistor of each channel, and alternately with each channel, such as for example transistors 36-39, to be devoid of a storage element coupled in parallel to the parasitic gate-to-source capacitor. For example, controller 60 may be configured such that a latch or memory of flip-flop is not connected in parallel to capacitor 69 of the channel that includes transistor 36. Also, in an embodiment there is not another capacitor connected in parallel to capacitor 69.

Figure 4:
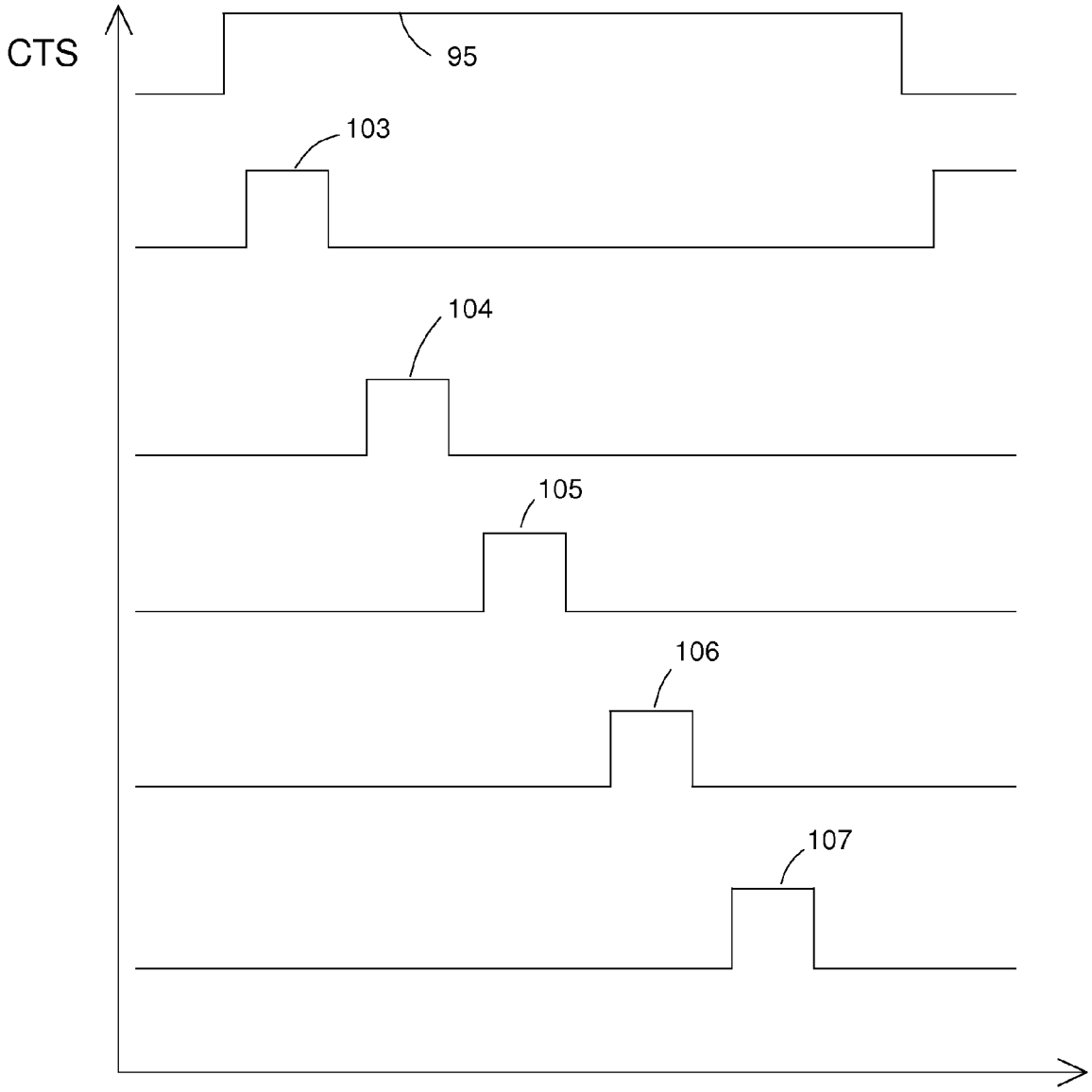
FIG. 4 is another graph having plots illustrating some examples of some of the signals that may be formed by one example embodiment of the controller of FIG. 2 in accordance with the present invention.

FIG. 4 is a graph illustrating some of the signals formed by an example of an embodiment of controller 60. The abscissa indicates time and the ordinate indicates increasing value of the illustrated signal. A plot 95 illustrates a CTS sequence. Plot 103 illustrates states, such as for example asserted and negated states, of a control signal used to operate switches 90 and 91. A plot 104 illustrates states of a control signal used to enable switches 65 and 66 and charge capacitor 69 to enable transistor 36, a plot 105 illustrates states of a control signal used to enable switches 72-73 and charge capacitor 76 to enable transistor 37, a plot 106 illustrates states of a control signal used to operate switches 80-81 and charge capacitor 84 to enable transistor 38, and a plot 107 illustrates a control signal used to operate the corresponding charge switches of circuit 86 and enable transistor 39. This description has references to FIG. 2 and FIG. 4.

For one example of a charge transfer sequence (CTS), in the charging time interval, capacitor 57 is charged as illustrated by the asserted portion of plot 103. Subsequently, there may follow N time intervals that include N gate charge intervals (GCI) as illustrated by the asserted states of plots 104-107. For each of these gate charge intervals, capacitor 57 may be connected to the corresponding transistor of transistors 36-39 if the transistor should be turned-on or alternately should be kept on or refreshed. The charge transfer sequence (CTS) may include multiple sequential gate charge intervals (GCI) before capacitor 57 is recharged as illustrated by FIG. 4. Those skilled in the art will appreciate that controller 60 may be configured to omit a GCI during a CTS for any one of transistors 36-39 that is not intended to be enabled or is intended to be disabled. For example, if LED 13 is intended to be on and producing light, then transistor 37 is intended to be off or disabled. Thus, in an embodiment controller 60 may be configured to omit a GCI for transistor 37. Additionally, in a gate charge interval (GCI) it is possible to enable other of transistors 36-39. For example, if transistor 37 were off or disable during a previous GCI, then transistor 37 may be enabled, if such is desired, in a current GCI. Additionally, in an embodiment, a GCI may be used to refresh the gate charge of one of transistors 36-39 which was previously enabled during a previous GCI.

An embodiment of controller 60 may include that controller 60 may be configured to form a new charge transfer sequence (CTS) at the end of any gate charge interval (CGI) to recharge capacitor 57 and subsequently form other gate charge intervals (GCIs). For example, in an embodiment, after switches 72-73 are enabled and then disabled as illustrated by plot 105, controller 60 may initiate another CTS (not shown in FIG. 4) before switches 80-81 are enabled. Since the new CTS begins after one GCI is completed and prior to a subsequent immediately following CGI, all of charge switches 65-66, 72-73, 80-81, and other corresponding charge switches are disabled. Thus, the new CTS begins by enabling switches 90-91 to re-charge capacitor 57. The first GCI of the new CTS may begin where the previous CGI left off. For example, the first CGI of the new CTS may begin by enabling switches 80-81. Alternately, the first CGI of the new CTS may begin with another channel. For example, may begin at the first channel such as by enabling switches 65-66. All of the enabled ones of transistors 36-39 may remain enabled as controller 60 begins the new CTS since the Cgs of the corresponding transistors was previously charged.

It can thus be appreciated by one skilled in the art that an embodiment may include that transistors 36-39 do not have to be turned-off or disabled in order to charge capacitor 57 or to re-charge capacitor 57 or in order to transfer charge from capacitor 57 to any one of transistors 36-39. In one embodiment, transistors 36-39 may be turned-off only for controlling the intensity of LEDs 12-15.

In an embodiment, the disable switches of the channels may be configured to disable the switch transistor that corresponds to the channel. To be able to switch on a LED in the LED string, the corresponding switch transistor should be disabled. In one embodiment, disable switches 67, 74, 82, and 87 are configured to selectively disable corresponding switch transistors 36-39. Disable switches 67, 74, 82, and 87 may be configured to selectively disable or turn-off any of transistors 36-39 to allow the corresponding LED of LEDs 12-15 to receive current 19. Enabling one of switches 67, 74, 82, and 87 discharges the gate-source capacitance of respective capacitors 69, 76, 84, and 88 to disable the corresponding one of respective transistors 36-39.

Figure 5:
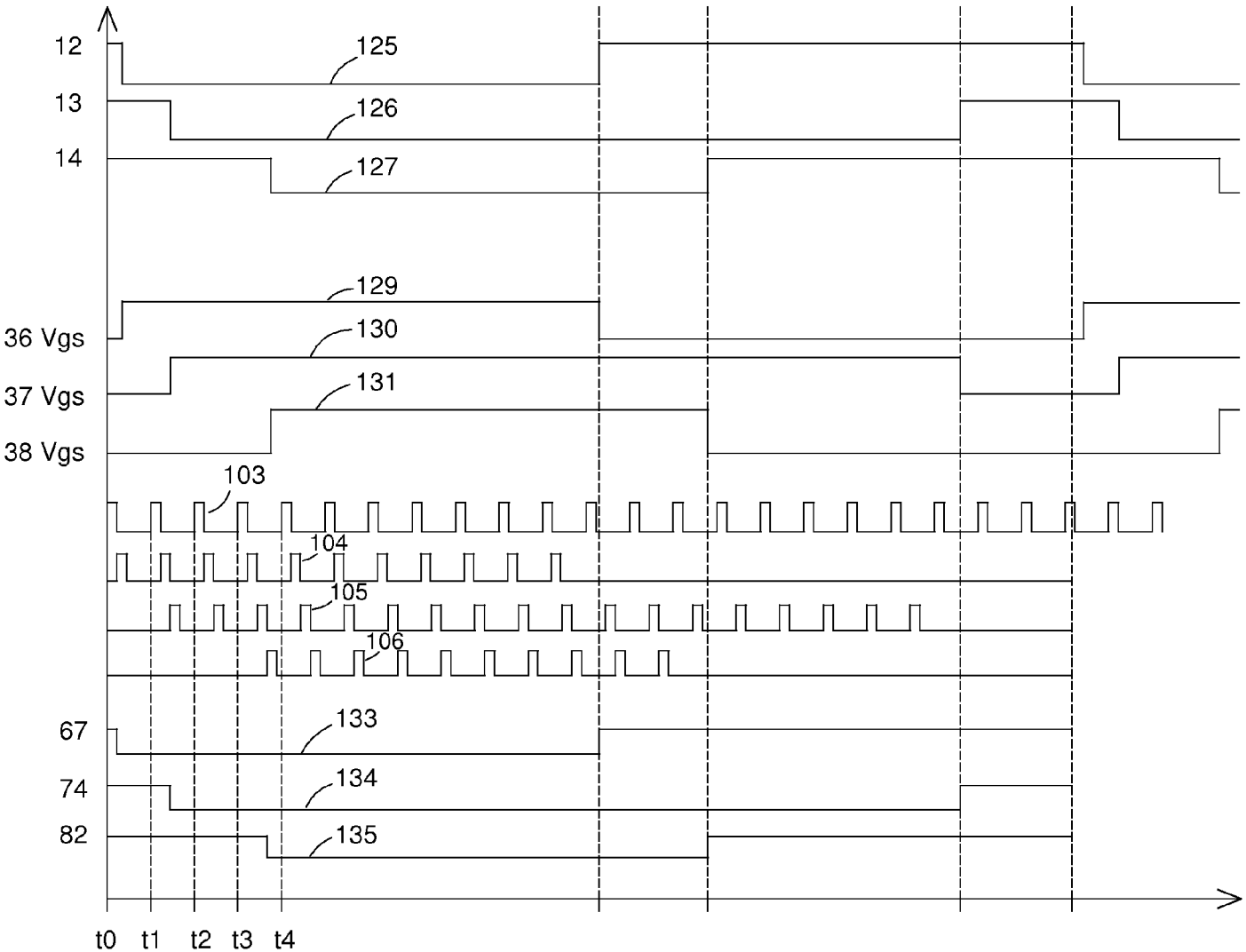
FIG. 5 is another graph having plots illustrating some examples of some of the signals that may be formed by one example embodiment of the controller of FIG. 2 in accordance with the present invention.

FIG. 5 is a graph having plots that illustrate some of the signals that are formed by controller 60 during one example operation of controller 60. In one non-limiting example embodiment, controller 60 may be configured to form or control a PWM dimming operation. A plot 125 illustrates in a general manner the current flow through LED 12, a plot 126 illustrates in a general manner the current flow through LED 13, and a plot 127 illustrates in a general manner the current flow through LED 14. A plot 129 illustrates in a general manner the Vgs of transistor 36, a plot 130 illustrates in a general manner the Vgs of transistor 37, and a plot 131 illustrates in a general manner the Vgs of transistor 38. A plot 133 illustrates in a general manner states of a control signal used to enable switch 67 and disable transistor 36, a plot 134 illustrates in a general manner states of a control signal used to enable switch 74 and disable transistor 37, and a plot 135 illustrates in a general manner states of a control signal used to enable switch 82 and disable transistor 38. The abscissa indicates time and the ordinate indicates increasing value of the illustrated signal.

The PWM dimming sequence illustrated in FIG. 5 illustrates a periodic recharge of capacitor 57 and then sequentially selectively enabling appropriate ones of transistors 36-38 to switch off or disable selected ones of respective LEDs 12-14. Those skilled in the art will appreciate that although the sequence is explained for only transistors 36-38, the sequence may be extended to any number of LEDs and corresponding transistors such as transistors 36-38. When an LED should be enabled, a corresponding one of disable switches 67, 74, or 82 may be enabled ensuring that the Vgs of the corresponding transistor 36-38 has a voltage that is less than the corresponding threshold voltage to disable the selected one of transistors 36-38.

Referring to FIG. 5, a first CTS is initiated between a time t0 and a time t1. During the first CTS, switches 90-91 are enabled and subsequently disabled to charge capacitor 57 as illustrated by plot 103. Subsequently, during a first GCI switch 67 is disabled (plot 133) and switches 65-66 are enabled (Plot 104) to enable transistor 36 to disable LED 12. During a second and third GCI switches 74 and 82 are one of enabled or re-enabled (plots 134 and 135) such that transistors 37-38 are disabled or maintained disabled to enable LEDs 13-14. Thus, switch 67 is disabled and switches 74 and 82 are enabled or re-enabled as illustrated by plots 133-135. Between times t1 and t2, a second CTS is performed.

During the second CTS capacitor 57 is again charged as illustrated by plot 103. Subsequently, during a first GCI, switch 67 remains disabled (plot 133) and switches 65-66 are enabled (plot 104) to re-charge or re-fresh capacitor 69 and re-enable transistor 36 (plot 129) to disable LED 12 (plot 125). Sequentially, during a second GCI switch 74 becomes disabled (plot 134) and switches 72-73 become enabled (plot 105) to enable transistor 37 to disable LED 13. Thus, switch 67 remains disabled and switch 74 becomes disabled to allow enabling transistor 37.

A third CTS may be performed between times t2 and t3. During the third CTS, capacitor 57 is again charged as illustrated by plot 103. There is no change in the state of LEDs 12-14 and transistors 36-39 during the third CTS.

As illustrated by plots 104-106, a fourth CTS may be performed between times t3 and t4. During the fourth CTS capacitor 57 is again charged as illustrated by plot 103. During the first GCI, switch 67 remains disabled (plot 133) and switches 65-66 are enabled (plot 104) to re-charge capacitor 69 and re-enable transistor 36. During the second GCI, switch 74 remains disabled (plot 134) and switches 72-73 are enabled (plot 105) to re-charge capacitor 76 and re-enable transistor 37. During the third GCI, switch 82 becomes disabled (plot 135) and switches 80-81 are enabled (plot 106) to charge capacitor 84 and enable transistor 38.

Those skilled in the art will appreciate that controller 60 may be configured to form a period of the CTS as a fixed time interval that includes sufficient time for GCI sequences for all of the switch transistors or alternately controller 60 may be configured to selectively vary the period of the CTS to include time for GCI sequences for only the ones of the switch transistors that are selected to be enabled or re-enable during the CTS. Those skilled in the art will also appreciate that if any one of switches 67, 74, 82, and 87 are to be enabled during a CTS, one or more of the disable switches may be enabled in response to initiating the CTS or alternately in response to the end of the charging interval of the CTS or in response to initiating the first GCI. In another embodiment, if any one of switches 67, 74, 82, and 87 are to be enabled during a CTS, the selected one of switches 67, 74, 82, and 87 may be enabled in response to initiating the CGI for the channel that corresponds to the selected one of switches 67, 74, 82, and 87. An embodiment may include that any one of switches 67, 74, 82, and 87 may be enabled at any time except when one of respective switches 65-66, 72-73, 80-81, or the charge switches of circuit 86 are enabled. For example, circuit 60 may be configured to enable any one of switches 67, 74, 82, and 87 as explained in any of the preceding sentences.

In one non-limiting example embodiment of a PWM dimming operation, three LEDs, such as LEDs 12-14 for example, and the respective ones of transistors 36-38 may have different PWM duty cycles to provide different brightness for the corresponding LED. For one non-limiting example, transistor 36 across LED 12 runs with approximately a fifty percent (50%) duty cycle, transistor 37 across LED 13 with approximately a twenty percent (20%) duty cycle, and transistor 38 across LED 14 with approximately a fifty five (55%) duty cycle. The duty cycle of the LED corresponds to the light intensity formed by the LED. In an embodiment, the PWM period is much longer than the charging time interval, for example T1 (FIG. 3), and the transfer interval, such as T2 (FIG. 3). Controller 60 may be configured to form the PWM dimming operation such that enabling each of transistors 36-38 to switch off the correspond LED is staggered in time or is de-phased.

Those skilled in the art will appreciate that any one of switches 65-66, 67, 72-74, 80-81, or 87, or the charge switches of circuit 86 may be formed as plurality of transistors. The plurality of transistors may include one or more N-channel transistors and/or one or more p-channel transistors. For example, switch 65 may be formed to include a P-channel transistor and a plurality of N-channel transistors.

In order to facilitate the foregoing described functionality, controller 60 is configured to include terminal 61 that is configured for coupling to a first terminal of capacitor 57, and to include terminal 62 that is configured for coupling to a second terminal of capacitor 57. Switch 91 includes a first current carrying electrode that is configured for coupling to a first voltage supply, such as for example for coupling to terminal 33, and a second current carrying electrode that is commonly connected to terminal 62 and to a node 68. In an embodiment, a control electrode of switch 90 may be connected to receive a first control signal from logic 89 to operate switch 90, and a control electrode of switch 91 may be connected to receive a different control signal from logic 89 to operate switch 91 separately from operating switch 90. In another embodiment, the control electrode of switch 91 may be connected to a control electrode of switch 90 and coupled to receive a first control signal from logic 89 in order to operate switch 90 together with operating switch 91. Switch 90 includes a first current carrying electrode that is commonly connected to terminal 61 and to a node 63. A second current carrying electrode of switch 90 is configured to be coupled to receive voltage V1. Switch 65 includes a first current carrying electrode that is connected to node 63, and a second current carrying electrode that is connected to a gate of transistor 36. A first current carrying electrode of switch 66 is connected to node 68, and a second current carrying electrode of switch 66 is connected to the source of transistor 36. In an embodiment, the control electrode of switch 66 may be commonly connected to a control electrode of switch 65 and is coupled to receive a second control signal, such as for example a first enable signal, from logic 89. In an alternate embodiment, the control electrode of switch 66 may be connected to the second current carrying electrode of switch 65 and not to the second control signal from logic 89. A first current carrying electrode of switch 67 is connected to the gate of transistor 36, and a second current carrying electrode of switch 67 is connected to the source of transistor 36. A control electrode of switch 67 is coupled to receive a third control signal, such as for example a first disable signal, from logic 89. Switch 72 has a first current carrying electrode connected to node 63, and a second current carrying electrode connected to a gate of transistor 37. Switch 73 has a first current carrying electrode connected to node 68, and a second current carrying electrode connected to the source of transistor 37. In an embodiment, the control electrode of switch 72 may be commonly connected to a control electrode of switch 73 and may be coupled to receive a fourth control signal, such as for example a second enable control signal, from logic 89. In an alternate embodiment, the control electrode of switch 73 may be connected to the second current carrying electrode of switch 72 and not to the fourth control signal from logic 89. A first current carrying electrode of switch 74 is connected to the gate of transistor 37 and a second current carrying electrode is connected to the source of transistor 37. A control electrode of switch 74 is coupled to receive a fifth control signal, such as for example a second disable control signal, from logic 89. Switch 80 has a first current carrying electrode connected to node 63 and a second current carrying electrode connected to the gate of transistor 38. A first current carrying electrode of switch 81 is connected to node 68 and a second current carrying electrode is connected to the source of transistor 38. In an embodiment, the control electrode of switch 80 may be commonly connected to a control electrode of switch 81 and coupled to receive a sixth control signal, such as for example a third enable control signal, from logic 89. In an alternate embodiment, the control electrode of switch 81 may be connected to the second current carrying electrode of switch 80 and not to the sixth control signal from logic 89. Switch 82 has a first current carrying electrode connected to the gate of transistor 38, and a second current carrying electrode connected to the source of transistor 38. A control electrode of switch 82 is coupled to receive a seventh control signal, such as for example a third disable control signal, from logic 89. The switches of circuit 86 have a similar configuration relative to transistor 39.

Figure 6:
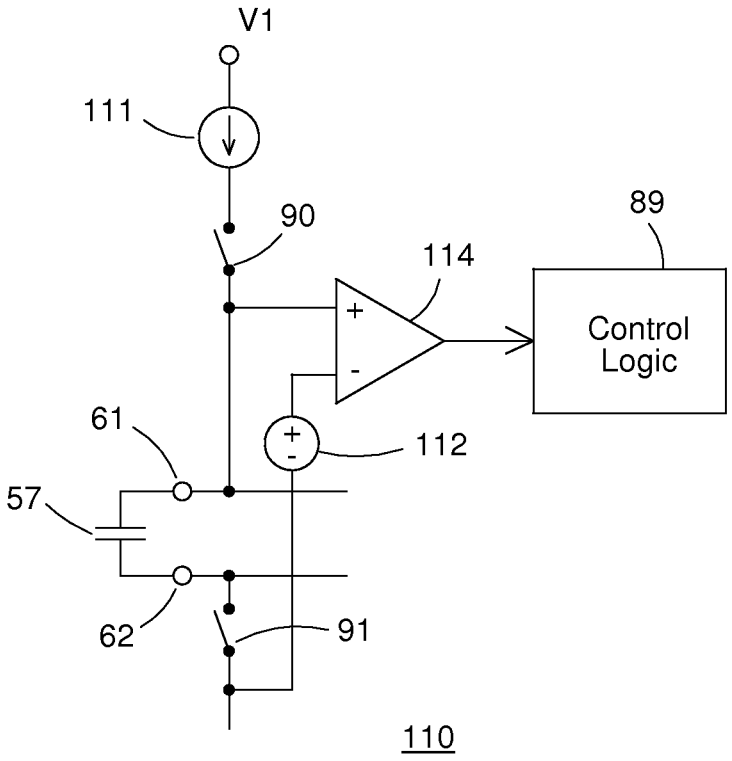
FIG. 6 schematically illustrates a portion of an example of an embodiment of a charging circuit that may be an alternate embodiment of a portion of the controller of FIG. 2 in accordance with the present invention.

FIG. 6 schematically illustrates a portion of an example of an embodiment of a charging circuit that is an alternate embodiment of a portion of controller 60. Capacitor 57 may be charged by other methods. In one embodiment, controller 60 may be configured to charge capacitor 57 from a current source 111. In one example embodiment, current source 111 may receive operating power from voltage V1. For example, during at least a portion of the charging interval of the CTS, switches 90 and 91 are on and capacitor 57 may be charged by current source 111. In an embodiment, the charging interval may be terminated after a fixed time interval. In another embodiment, the charging interval may be terminated in response to charging capacitor 57 to a first value or a desired value. For example, a comparator 114 may be configured to monitor the voltage on capacitor 57. If the voltage on capacitor 57 reaches the first value or the desired value or a desired level, then comparator 114 asserts or changes the state of the output of comparator 114. The first value is illustrated as a reference value, such as a reference voltage for example, from a reference circuit or voltage reference 112. In one embodiment, the reference value from reference 112 may be a value that is less than value V1. An embodiment may include that the reference value from reference 112 may be between approximately two volts and approximately five volts. In an embodiment, the reference value from reference 112 may be approximately three and three tents volts (3.3V). Controller 60, or alternately logic 89, may be configured to detect the asserted output and responsively disable switches 90-91. Disabling switches 90-91 may terminate the charging interval or the charging interval may continue after switches 90-91 are turned-off. Following operations, such as following CGI operations, may be the same as explained in the description of FIGS. 1-5.

Figure 7:
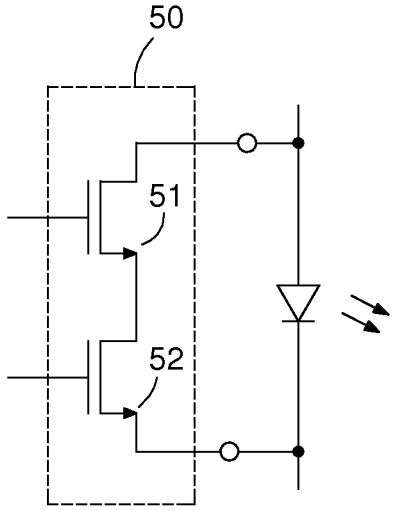
FIG. 7 schematically illustrates a portion of an example of an embodiment of a switch transistor that may be an alternate embodiment of a transistor of the controller of FIG. 2 in accordance with the present invention.

FIG. 7 schematically illustrates a portion of an example of an embodiment of a switch transistor 50 that is an alternate embodiment of transistor 36 (FIG. 2) or any of transistors 36-39. Those skilled in the art will appreciate that any or each of transistors 36-39 may be several transistors in parallel or in series and that they are illustrated as single transistors in FIG. 1 and FIG. 2 for simplicity of the drawings and descriptions. Additionally, those skilled in the art will appreciate that the charge switches, disable switches, and other switches illustrated may each be formed from one or more transistors in series or in parallel to implement the switch and the associated function. Those skilled in the art will also understand that the combination of equivalent transistors that may form the switches can be considered to have first and second current carrying electrodes as the terminals through which current flows through the switch and to have a control electrode as the terminal that opens or disables and closes or enables the switch. The control electrodes of transistors 51 and 52 may be controlled separately as illustrated in FIG. 7 or may be connected together and controlled by a single control signal. Those skilled in the art will appreciate that in one embodiment the first current carrying electrode of transistor 50 may be the drain of transistor 51 and that the source of transistor 52 may be the second current carrying electrode of transistor 50. In another embodiments, the first and second current carrying electrodes may be reversed, or in other embodiments the source and drain electrodes of transistors 51 and 52 may be different, such as for example as P-channel transistors.

Figure 8:
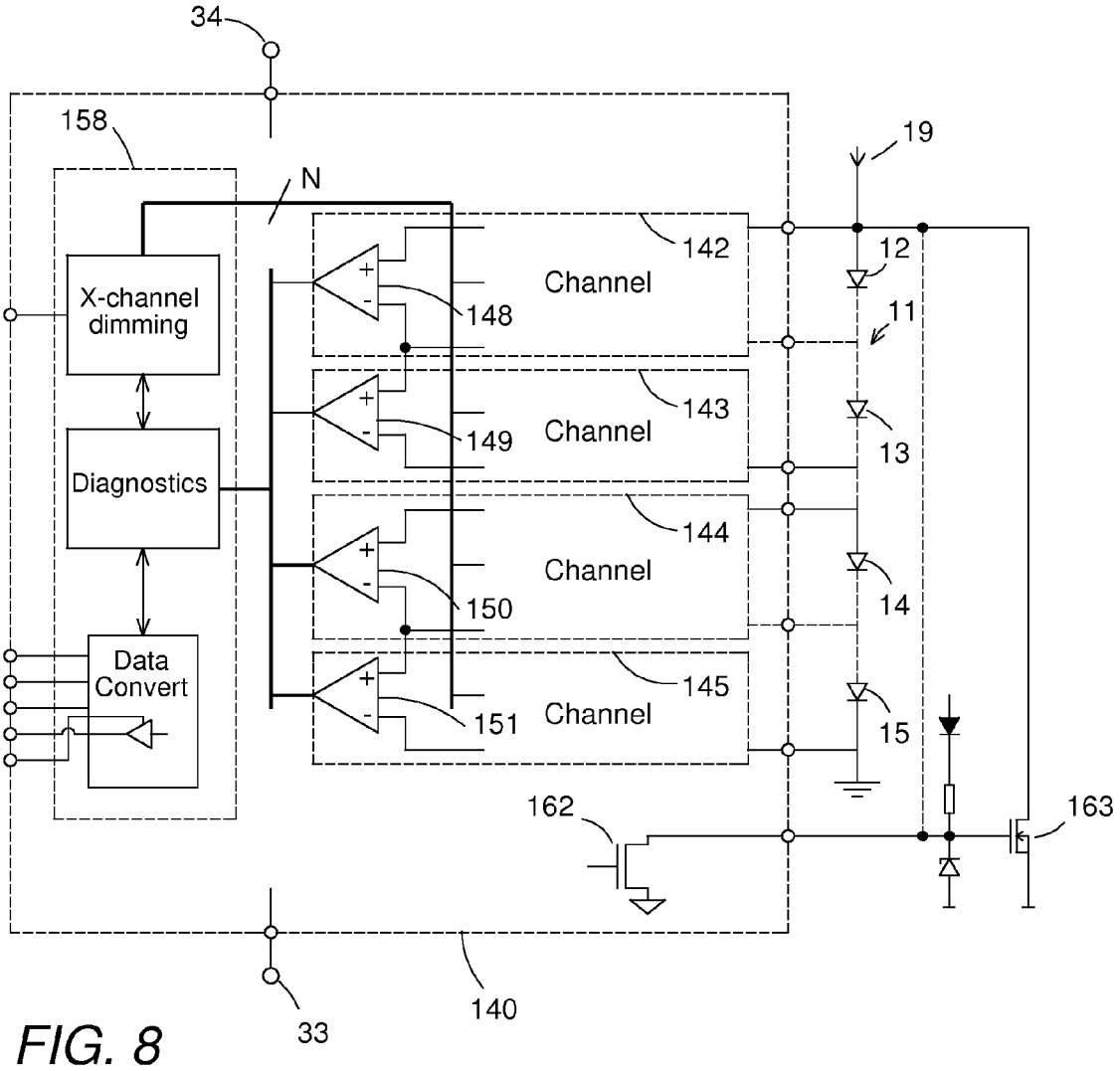
FIG. 8 schematically illustrates a portion of an example of an embodiment of an LED controller that may be an alternate embodiment of either or both of the LED controllers of respective FIGS. 1 and 2 in accordance with the present invention.

FIG. 8 schematically illustrates a portion of an example of an embodiment of an LED controller 140 that is an alternate embodiment of either or both of controllers 32 and 60 of respective FIGS. 1 and 2. Controller 140 may be configured to include a plurality of control channels 142-145 that are substantially similar to and operate substantially similar to the control channels of controller 60. Controller 140 is substantially the same as and operates substantially the same as controller 60 except that controller 140 includes a control logic circuit or controller logic 158 that is an alternate embodiment of logic 89 of controller 60. In an embodiment, logic 158 may be substantially the same as and operate substantially the same as control logic 47 that was described in the description of FIG. 1. However, logic 158 includes circuit blocks that may or may not be included in logic 89. Logic 158 is configured to include a dimming circuit, a diagnostics circuit, and a data conversion or data convert circuit. The data convert circuit may be configured to receive commands providing instructions identifying which of LEDs 12-15 that are to be enabled and disabled and the intensity of each LED. The dimming circuit may receive the LED information from the data conversion circuit and form N signals or N pairs or N groups of signals for operating the elements of channels 142-145.

An embodiment of channels 142-145 may include diagnostic circuits to provide diagnostic signals to logic 158. The diagnostic circuits of channels 142-145 may include respective comparators 148-151. Comparator 148 may be configured to receive signals that are representative of the voltage drop across LED 12 and form a diagnostic signal that is representative of the voltage across LED 12 having a value that is greater than an overvoltage threshold value, and to provide the diagnostic signal to logic 158. Comparators 149-151 may for similar diagnostic signals for the other respective channels.

Controller 140 may also include a disable transistor 162 that is configured to disable all of LEDs 12-15. Transistor 162 may be controlled by logic 158. Transistor 162 may be configured to control another transistor 163 that is connected in parallel to LED string 11. Logic 158 may be configured to disable transistor 162 in order to enable transistor 163 to shunt LED current 19 away from LEDs 12-15 and prevent LEDs 12-15 from forming light. In an embodiment, transistor 162 may be configured to be connected in parallel to LEDs 12-15, as illustrated by a dashed line, and transistor 163 may be omitted. For such a case, the signal to transistor 162 may be inverted.

Figure 9:
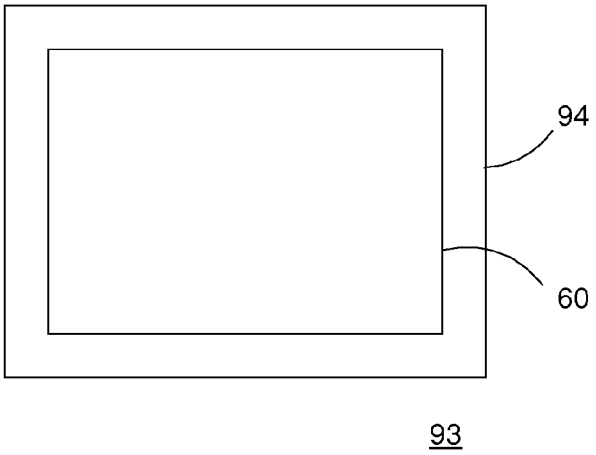
FIG. 9 illustrates an enlarged plan view of a semiconductor device that includes the controller of one of FIG. 1, FIG. 2, or FIG. 8 in accordance with the present invention.

FIG. 9 illustrates an enlarged plan view of a portion of an embodiment of a semiconductor device or integrated circuit 93 that is formed on a semiconductor die 94. One or more of controllers 32 or 60 or 140 may be formed on die 94. Die 94 may also include other circuits that are not shown in FIG. 9 for simplicity of the drawing. Controllers 32 or 60 or 140 and device or integrated circuit 93 are formed on die 94 by semiconductor manufacturing techniques that are well known to those skilled in the art.

Those skilled in the art will appreciate that an embodiment of an LED controller may comprise:

a charge circuit having a first charge switch, such as for example switch 90, configured to selectively couple a first terminal of a charge capacitor, such as for example capacitor 57, to receive a first voltage, such as for example voltage V1, and having a second charge switch, such as for example switch 91, configured to switch a second terminal of the charge capacitor to receive a second voltage;

a first LED transistor, such as for example transistor 36, having a first current carrying electrode for coupling to a first terminal of a first LED, such as for example LED 12, a second current carrying electrode for coupling to one of a second terminal of the first LED or a first terminal of a second LED that is in series with the first LED, and a control electrode;

a first switch, such as for example switch 65, coupled in series between the control electrode of the first LED transistor and a first node, such as for example node 63, the first switch having a control electrode;

a second switch, such as for example switch 66, coupled in series between the second current carrying electrode of the first LED transistor and a second node, such as for example node 68, the second switch having a control electrode;

a second LED transistor, such as for example transistor 37, having a first current carrying electrode coupled to the second current carrying electrode of the first LED transistor, a second current carrying electrode configured for coupling to one of a second terminal of the second LED, such as for example LED 13, or a first terminal of a third LED such as for example another LED in series with LED 13, and a control electrode;

a third switch, such as for example switch 72, coupled in series between the control electrode of the second LED transistor and the first node, the third switch having a control electrode;

a fourth switch, such as for example switch 73, coupled in series between the second current carrying electrode of the second LED transistor and the second node, the fourth switch having a control electrode; and a control circuit, such as for example control logic 89, configured to form a plurality of time intervals and a plurality of control signals to operate the first, second, third, and fourth switches wherein the control circuit is configured to form a first time interval to charge the charge capacitor, to form a second time interval to enable the first and second switches to couple the charge capacitor between the control electrode and the second current carrying electrode of the first LED transistor, and to form a third time interval to enable the third and fourth switches to couple the charge capacitor between the control electrode and the second current carrying electrode of the second LED transistor.

In an embodiment, the LED controller may include that the third time interval may be subsequent to the second time interval and wherein the charge capacitor is not charged between the second and third time intervals.

An embodiment of the LED controller may also include a first disable switch coupled between the control electrode and the second current carrying electrode of the first LED transistor and also including a second disable switch coupled between the control electrode and the second current carrying electrode of the second LED transistor.

Another embodiment may also include that the first node may be configured for coupling to the first terminal of the charge capacitor and the second node is configured for coupling to the second terminal of the charge capacitor.

An embodiment of the LED controller may include that the control circuit forms a control signal and couples the control signal to a control terminal of the first and second switches to enable the first and second switches for at least a portion of the second time interval.

In another embodiment, the control circuit may be configured to couple the control signal to the control electrode of the third and fourth switches to enable the third and fourth switches for at least a portion of the third time interval.

Another embodiment may include that the control circuit is configured to form another control signal and couple the another control signal to a control electrode of the first and second charge switches to enable the first and second charge switches for at least a portion of the first time interval but not during the second or third time intervals and not between the second and third time intervals.

An embodiment may include that the first switch includes a first current carrying electrode for coupling to the control electrode of the first LED transistor, and a second current carrying electrode coupled to the first node, and wherein the second switch includes a first current carrying electrode coupled to the second current carrying electrode of the first LED transistor and a second current carrying electrode coupled to the second node.

Another embodiment may include that the third switch includes a first current carrying electrode coupled to the control electrode of the second LED transistor and a second current carrying electrode coupled to the first node, and wherein the fourth switch includes a first current carrying electrode coupled to the second current carrying electrode of the second LED transistor and a second current carrying electrode coupled to the second node.

In an embodiment the control circuit may be configured to form another control signal and couples the another control signal to a control electrode of the first and second charge switches to enable the first and second charge switches between the second and third time intervals.

Those skilled in the art will appreciate that a method of forming an LED controller may comprise:

forming a plurality of LED transistors, such as for example transistors 36-39, for coupling in parallel with a plurality of LEDs that are coupled in a series string of LEDs, such as for example string 11;

configuring the LED controller to form a charge transfer sequence having a plurality of time intervals;

configuring the LED controller to selectively charge a charge capacitor to a first voltage for at least a portion of a first time interval, such as for example a portion of interval T1, of the plurality of time intervals;

configuring the LED controller to selectively couple the charge capacitor between a control electrode and first current carrying electrode of a first LED transistor of the plurality of LED transistors for at least a portion of a second time interval, such as for example at least a portion of interval T2, of the plurality of time intervals; and configuring the LED controller to selectively couple the charge capacitor between a control electrode and first current carrying electrode of a second LED transistor of the plurality of LED transistors for at least a portion of a third time interval, such as for example a portion of a subsequent T2 interval, of the plurality of time intervals.

An embodiment of the method may also include configuring the LED controller to enable a first disable switch, such as for example switch 67, to discharge a gate-to-source capacitance of the first LED transistor.

Another embodiment may include configuring the LED controller to enable the first disable switch responsively independently of any of the first or second time intervals.

An embodiment may include configuring the LED controller to enable a second disable switch to discharge a gate-to-source capacitance of the second LED transistor responsively to one of a third time interval or a fourth time interval.

Those skilled in the art will appreciate that another method of forming an LED controller may comprise:

configuring the LED controller to form a charge transfer sequence to selectively enable LED transistors, such as for example transistors 36-39, of a plurality of LED transistors that are configured for coupling in parallel with a plurality of LEDs, such as for example LEDs 12-15; and configuring the LED controller to sequentially couple a charge capacitor, such as for example capacitor 57, to a gate-to-source capacitor, such as for example one of capacitor 69, 76, 84, or 88, of each LED transistor of the plurality of LED transistors to one of charge or to refresh the gate-to-source capacitor of a respective LED transistor and to one of enable or re-enable the respective LED transistor wherein the gate-to-source capacitor is a parasitic gate-to-source capacitor of a corresponding LED transistor including configuring the LED controller to sequentially couple the charge capacitor to the gate-to-source capacitor of each LED transistor.

Another embodiment of the method may include configuring the LED controller to sequentially couple the charge capacitor includes configuring the LED controller to selectively couple the charge capacitor to a first gate-to-source capacitor of a first transistor of the plurality of LED transistors to one of selectively charge or refresh the first gate-to-source capacitor to one of enable or re-enable the first transistor; and configuring the LED controller to selectively couple the charge capacitor to a second gate-to-source capacitor of a second transistor of the plurality of LED transistors to one of selectively charge or refresh the second gate-to-source capacitor to one of enable or re-enable the second transistor wherein the LED controller is configured to not charge the charge capacitor after coupling the charge capacitor to the first gate-to-source capacitor and prior to coupling the charge capacitor to the second gate-to-source capacitor.

In an embodiment, the method may also include configuring the LED controller to decouple the charge capacitor from the first gate-to-source capacitor prior to coupling the charge capacitor to the second gate-to-source capacitor.

Another embodiment may also include configuring the LED controller to selectively charge the charge capacitor after coupling the charge capacitor to the first gate-to-source capacitor and prior to coupling the charge capacitor to the second gate-to-source capacitor responsively to the charge on the charge capacitor having a first value.

An embodiment may include configuring each LED transistor to be devoid of another capacitor coupled in parallel to the parasitic gate-to-source capacitor wherein the charge capacitor is sequentially coupled to the gate-to-source capacitor of the LED transistors.

Another embodiment may include configuring each LED transistor to be devoid of a storage element coupled in parallel to the parasitic gate-to-source capacitor.

In view of all of the above, it is evident that a novel device and method is disclosed. Included, among other features, is forming an LED controller to sequentially connect a charge capacitor to a parasitic gate-to-source capacitance of a switch transistor to enable the switch transistor. Sequentially connecting the charge capacitor to different switch transistors eliminates the need to have a dedicated capacitor for each switch transistor. Sequentially enabling the transistors provides improved control of the value of the voltage used to enable the switch transistor. Those skilled in the art will understand that the method and apparatus does not have an effect on the switching of the LEDs, thus, does not affect the quality of the light emitted by the LEDs. Additionally, the power efficiency is improved over other methods of controlling the LEDs and no high voltage supply is needed to operate the LEDs. Also, controlling the slope of the gate voltage to the switch transistors is easily controlled as explained hereinbefore.

While the subject matter of the descriptions are described with specific preferred embodiments and example embodiments, the foregoing drawings and descriptions thereof depict only typical and examples of embodiments of the subject matter and are not therefore to be considered to be limiting of its scope, it is evident that many alternatives and variations will be apparent to those skilled in the art. As will be appreciated by those skilled in the art, the example form of controllers 32, 60, and 145 are used as a vehicle to explain the operation method of enabling the switch transistors. Although the subject matter of the embodiments are described using example embodiments of N-channel MOS transistors, other types of transistors may be used in other embodiments.

As the claims hereinafter reflect, inventive aspects may lie in less than all features of a single foregoing disclosed embodiment. Thus, the hereinafter expressed claims are hereby expressly incorporated into this Detailed Description of the Drawings, with each claim standing on its own as a separate embodiment of an invention. Furthermore, while some embodiments described herein include some but not other features included in other embodiments, combinations of features of different embodiments are meant to be within the scope of the invention, and form different embodiments, as would be understood by those skilled in the art.

The invention claimed is:

1. An LED controller comprising:

a charge circuit having a first charge switch configured to selectively couple a first terminal of a charge capacitor to receive a first voltage and having a second charge switch configured to switch a second terminal of the charge capacitor to receive a second voltage;

a first LED transistor having a first current carrying electrode for coupling to a first terminal of a first LED, a second current carrying electrode for coupling to one of a second terminal of the first LED or a first terminal of a second LED that is in series with the first LED, and a control electrode;

a first switch coupled in series between the control electrode of the first LED transistor and a first node, the first switch having a control electrode;

a second switch coupled in series between the second current carrying electrode of the first LED transistor and a second node, the second switch having a control electrode;

a second LED transistor having a first current carrying electrode coupled to the second current carrying electrode of the first LED transistor, a second current carrying electrode for coupling to one of a second terminal of the second LED or a first terminal of a third LED, and a control electrode;

a third switch coupled in series between the control electrode of the second LED transistor and the first node, the third switch having a control electrode;

a fourth switch coupled in series between the second current carrying electrode of the second LED transistor and the second node, the fourth switch having a control electrode; and a control circuit configured to form a plurality of time intervals and a plurality of control signals to operate the first, second, third, and fourth switches wherein the control circuit is configured to form a first time interval to charge the charge capacitor, to form a second time interval to enable the first and second switches to couple the charge capacitor between the control electrode and the second current carrying electrode of the first LED transistor, and to form a third time interval to enable the third and fourth switches to couple the charge capacitor between the control electrode and the second current carrying electrode of the second LED transistor.

2. The LED controller of claim 1 wherein the third time interval is subsequent to the second time interval and wherein the charge capacitor is not charged between the second and third time intervals.

3. The LED controller of claim 1 further including a first disable switch coupled between the control electrode and the second current carrying electrode of the first LED transistor and also including a second disable switch coupled between the control electrode and the second current carrying electrode of the second LED transistor.

4. The LED controller of claim 1 wherein the first node is configured for coupling to the first terminal of the charge capacitor and the second node is configured for coupling to the second terminal of the charge capacitor.

5. The LED controller of claim 1 wherein the control circuit is configured to form a control signal and couples the control signal to a control terminal of the first and second switches to enable the first and second switches for at least a portion of the second time interval.

6. The LED controller of claim 5 wherein the control circuit is configured to couple the control signal to the control electrode of the third and fourth switches to enable the third and fourth switches for at least a portion of the third time interval.

7. The LED controller of claim 1 wherein the control circuit is configured to form another control signal and to couple the another control signal to a control electrode of the first and second charge switches to enable the first and second charge switches for at least a portion of the first time interval but not during the second or third time intervals and not between the second and third time intervals.

8. The LED controller of claim 1 wherein the first switch includes a first current carrying electrode for coupling to the control electrode of the first LED transistor, and a second current carrying electrode coupled to the first node, and wherein the second switch includes a first current carrying electrode coupled to the second current carrying electrode of the first LED transistor and a second current carrying electrode coupled to the second node.

9. The LED controller of claim 1 wherein the third switch includes a first current carrying electrode coupled to the control electrode of the second LED transistor and a second current carrying electrode coupled to the first node, and wherein the fourth switch includes a first current carrying electrode coupled to the second current carrying electrode of the second LED transistor and a second current carrying electrode coupled to the second node.

10. The LED controller of claim 1 wherein the control circuit is configured to form another control signal and couples the another control signal to a control electrode of the first and second charge switches to enable the first and second charge switches between the second and third time intervals.

11. A method of forming an LED controller comprising:

forming a plurality of LED transistors for coupling in parallel with a plurality of LEDs that are coupled in a series string of LEDs;

configuring the LED controller to form a charge transfer sequence having a plurality of time intervals;

configuring the LED controller to selectively charge a charge capacitor to a first voltage for at least a portion of a first time interval of the plurality of time intervals;

configuring the LED controller to selectively couple the charge capacitor between a control electrode and first current carrying electrode of a first LED transistor of the plurality of LED transistors for at least a portion of a second time interval of the plurality of time intervals; and configuring the LED controller to selectively couple the charge capacitor between a control electrode and first current carrying electrode of a second LED transistor of the plurality of LED transistors for at least a portion of a third time interval of the plurality of time intervals.

12. The method of claim 11 further including configuring the LED controller to enable a first disable switch to discharge a gate-to-source capacitance of the first LED transistor.

13. The method of claim 12 including configuring the LED controller to enable the first disable switch responsively independently of any of the first or second time intervals.

14. The method of claim 12 further including configuring the LED controller to enable a second disable switch to discharge a gate-to-source capacitance of the second LED transistor responsively to one of a third time interval or a fourth time interval.

15. A method of forming an LED controller comprising:

configuring the LED controller to form a charge transfer sequence to selectively enable LED transistors of a plurality of LED transistors that are configured for coupling in parallel with a plurality of LEDs; and configuring the LED controller to sequentially couple a charge capacitor to a gate-to-source capacitor of each LED transistor of the plurality of LED transistors to one of charge or to refresh the gate-to-source capacitor of a respective LED transistor and to one of enable or re-enable the respective LED transistor wherein the gate-to-source capacitor is a parasitic gate-to-source capacitor of a corresponding LED transistor including configuring the LED controller to sequentially couple the charge capacitor to the gate-to-source capacitor of each LED transistor.

16. The method of claim 15 wherein configuring the LED controller to sequentially couple the charge capacitor includes configuring the LED controller to selectively couple the charge capacitor to a first gate-to-source capacitor of a first transistor of the plurality of LED transistors to one of selectively charge or refresh the first gate-to-source capacitor to one of enable or re-enable the first transistor; and configuring the LED controller to selectively couple the charge capacitor to a second gate-to-source capacitor of a second transistor of the plurality of LED transistors to one of selectively charge or refresh the second gate-to-source capacitor to one of enable or re-enable the second transistor wherein the LED controller is configured to not charge the charge capacitor after coupling the charge capacitor to the first gate-to-source capacitor and prior to coupling the charge capacitor to the second gate-to-source capacitor.

17. The method of claim 16 including configuring the LED controller to decouple the charge capacitor from the first gate-to-source capacitor prior to coupling the charge capacitor to the second gate-to-source capacitor.

18. The method of claim 16 including configuring the LED controller to selectively charge the charge capacitor after coupling the charge capacitor to the first gate-to-source capacitor and prior to coupling the charge capacitor to the second gate-to-source capacitor responsively to the charge on the charge capacitor having a first value.

19. The method of claim 15 including configuring each LED transistor to be devoid of another capacitor coupled in parallel to the parasitic gate-to-source capacitor wherein the charge capacitor is sequentially coupled to the gate-to-source capacitor of the LED transistors.

20. The method of claim 15 including configuring each LED transistor to be devoid of a storage element coupled in parallel to the parasitic gate-to-source capacitor.

* * * * *